United States Patent [19]

Dotson et al.

[11] 4,116,455

[45] Sep. 26, 1978

[54] SKATEBOARD SKI

[76] Inventors: Donald R. Dotson, 1837 Wallace Ave., Costa Mesa, Calif. 92627; Ronald R. Smith, 318 E. Berkeley St., Santa Ana, Calif. 92707

[21] Appl. No.: 775,290

[22] Filed: Mar. 7, 1977

[51] Int. Cl.[2] ..... A63C 17/18

[52] U.S. Cl. ..... 280/7.12; 280/7.14; 280/13; 280/16; 280/28; 280/87.04 A

[58] Field of Search ..... 280/87.04 A, 13, 7.13, 280/8, 10, 7.12, 600, 12 H, 16, 28, 7.14

[56] References Cited

U.S. PATENT DOCUMENTS

| | | | |
|---|---|---|---|
| 332,575 | 12/1885 | Wheeler | 280/16 |
| 1,802,116 | 4/1931 | Kinsley | 280/7.13 |
| 2,081,024 | 5/1937 | Turner | 280/13 |
| 2,437,622 | 3/1948 | Stryker | 280/13 |
| 3,153,543 | 10/1964 | Magyar | 280/87.04 R |
| 3,203,706 | 8/1965 | Beyden | 280/7.12 |
| 3,336,994 | 8/1967 | Pederson | 280/13 |
| 3,436,088 | 4/1969 | Kunselman | 280/87.04 R |
| 3,774,926 | 11/1973 | Chase | 280/13 |

FOREIGN PATENT DOCUMENTS

| | | | |
|---|---|---|---|
| 623,652 | 8/1961 | Italy | 280/600 |

*Primary Examiner*—David M. Mitchell
*Attorney, Agent, or Firm*—Francis X. LoJacono

[57] ABSTRACT

A skateboard ski apparatus wherein a skateboard platform and related skate trucks are combined with removable ski shoes, the ski shoe having a substantially flat body member provided on its lower surface with parallel runners, and on its upper surface with support ribs adapted to either receive wheels of an existing skateboard or the axles of the wheel-truck assembly. The forward end of the preferred arrangement of the ski shoe includes an upwardly turned end to allow the apparatus to slide over the snow. A second arrangement includes a ski shoe having both ends adapted with upturned ends so that the skateboard ski can be used in either a backward or forward direction.

2 Claims, 10 Drawing Figures

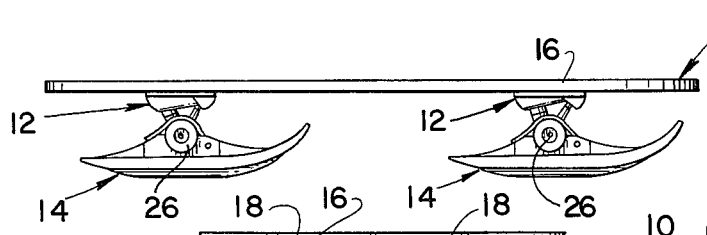
FIG. 1
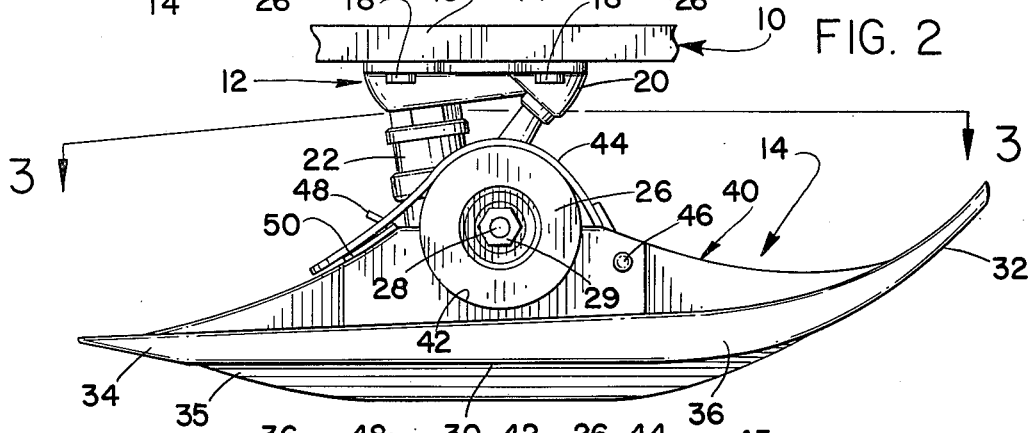
FIG. 2
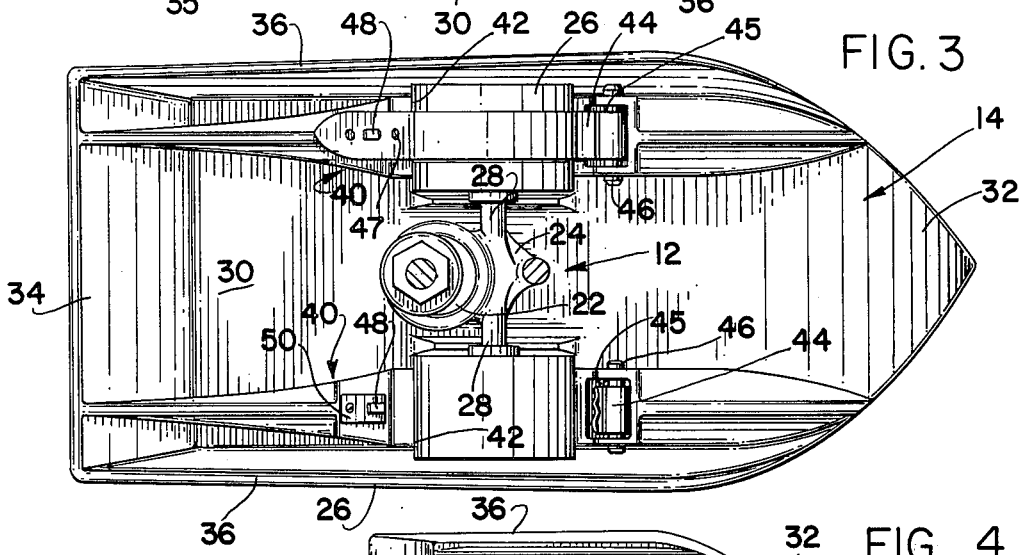
FIG. 3
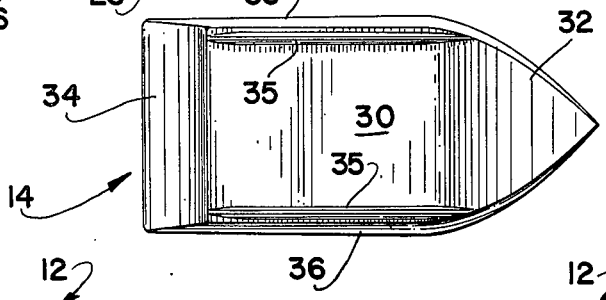
FIG. 4
FIG. 5
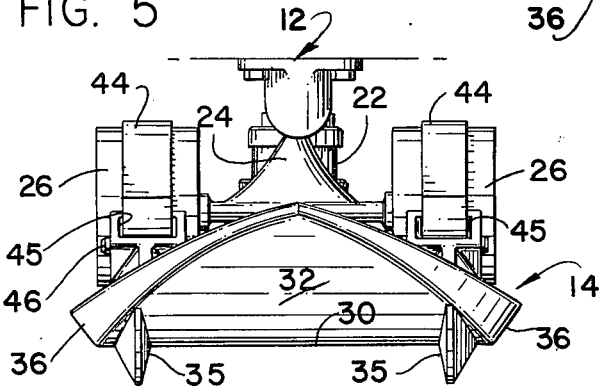
FIG. 6
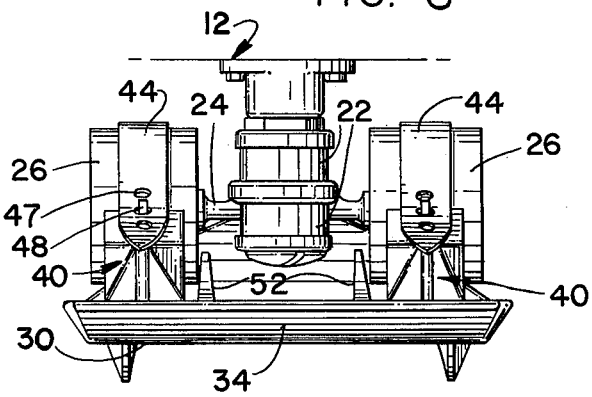

SKATEBOARD SKI

BACKGROUND OF THE INVENTION

1. Field of the Invention

This invention relates generally to an apparatus that is used as a skateboard and, more particularly, to a skateboard-ski device that operates on snow surfaces.

2. Description of the Prior Art

As is well known in the art of skateboards, this type of sporting device is now becoming popular world wide. Skateboards are generally used on smooth, flat surfaces so as to allow for better riding by easy acceptability of the wheels that are part of the device. However, at this time the skateboard is restricted in its use—not only to the type of surface of the ground area but also by weather conditions. That is, during the winter months, in areas that have snow conditions the ground surfaces become covered and a skateboard can not be operated.

Thus, the applicants herein are disclosing an apparatus that will permit the year-round use of a skateboard.

SUMMARY OF THE INVENTION

The present invention comprises a ski-shoe device that is adaptable to be combined with the well-known skateboard. The ski shoe is contemplated, as herein disclosed, to be so designed that it can be easily mounted to the wheels of most known types of skateboards, wherein the ski shoe comprises an elongated body member having a substantially flat mid-section, with the forward end being unturned, thus defining a nose portion to readily slide over the snow-covered ground when being operated. The under surface of each body member is provided with longitudinal, parallel runners to help control the forward movement of the skateboard ski. The upper surface includes a pair of parallel rib structures integrally formed as part of the ski-shoe body, wherein the rib structures are to be formed in two different configurations—defining two embodiments of the invention.

One form includes an enlarged, annular opening adapted to receive various sizes of wheels on the existing skateboards, a fastening device being included so as to securely attach a ski shoe to each wheel of both the forward and rearward trucks of the skateboard.

There is also disclosed herein an embodiment wherein the body member is provide with an upturned nose portion at both ends of the ski shoes, thereby allowing the shoes to move in either direction. This arrangement will permit the use thereof in trick riding.

OBJECTS AND ADVANTAGES OF THE INVENTION

The present invention has for an important object a provision wherein a well-known type of skateboard can be adapted to receive a pair of ski shoes thereon, whereby the skateboard can be used in the snow.

It is another object of the invention to provide a ski shoe adapted for use with a skateboard, wherein the wheels of the skateboard are replaced by the ski shoes.

It is still another object of the invention to provide a skateboard-ski device that is relatively inexpensive to manufacture, and is simple and rugged in its construction.

The characteristics and advantages of the invention are further sufficiently referred to in connection with the accompanying drawings, which represent one embodiment. After considering this example, skilled persons will understand that variations may be made without departing from the principles disclosed and we contemplate the employment of any structures, arrangements or modes of operation that are properly within the scope of the appended claims.

DESCRIPTION OF THE DRAWINGS:

Referring more particularly to the accompanying drawings, which are for illustrative purposes only:

FIG. 1 is a side-elevational view of a typical skateboard with the present invention attached thereto;

FIG. 2 is an enlarged, side-elevational view of a ski shoe attached to a wheel-and-truck assembly;

FIG. 3 is a cross-sectional view taken along line 3—3 of FIG. 2;

FIG. 4 is a bottom plan view of the ski shoe;

FIG. 5 is a front-elevational view of the present device attached to the wheel-and-truck assembly;

FIG. 6 is a rear-elevational view thereof;

DESCRIPTION OF THE PREFERRED EMBODIMENT

Figure 7:
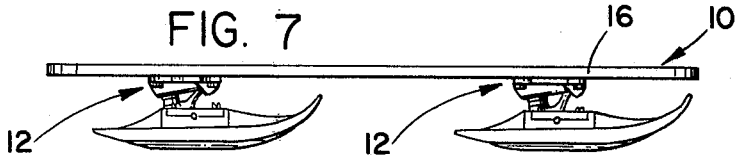
FIG. 7 is a side-elevational view of the present invention, wherein the ski shoes are attached directly to the truck assembly without the wheels.

Referring more particularly to FIG. 1 through 6, there is shown a typical, well-known type of skateboard, generally indicated at 10, having a pair of wheel-and-truck assemblies, designated by numeral 12. Each wheel-and-truck assembly is shown having a ski shoe, indicated generally at 14, attached thereto.

As is well known, the skateboard comprises an elongated skateboard platform 16, which is generally formed from a wood or plastic material, on which the user thereof places one foot, pushing the board in a forward direction along a ground surface before placing the other foot on the platform—thereby riding on the board with both feet. Thus, the platform or board has a pair of wheel-and-truck assemblies 12 mounted thereto, as shown in FIG. 1. That is, one truck assembly is mounted to the rear thereof. The trucks are generally fastened to the underside of platform 12 by screws or bolts 18. Each wheel-and-truck assembly comprises a structural body 20 wherein one or more resilient members 22 are attached thereto in such a manner as to allow the axle members 24 to move relative to structural body 20. The details of the wheel-and-truck assembly are well known in the art of skateboards.

As is understood and shown in FIGS. 1 through 6, each truck assembly includes a pair of wheels 26 which are mounted to laterally extending axles 28 and held thereon by nut 29.

In order to extend the use of the skateboard by making it adaptable for snow conditions, ski shoes 14 are so arranged as to be removably secured to the wheels of the truck. Thus, the ski-shoe device comprises a somewhat elongated body member 30 wherein the mid-section thereof is substantially flat, and has a steep upturned nose portion 32 formed in the forward end thereof. This nose portion is similar to the well-known water and snow skis, and is designed to accomplish the same purpose.

As the mid-section of the body extends rearwardly, its width will be generally a little wider than the width of the wheels 26. Since there is a variety of sizes of wheels, and this will allow for wider widths for wheels. The body can also have a continuously extended width; but it is herein shown in the preferred form wherein the body width is slightly tapered inwardly as it projects rearwardly.

Accordingly, the length of the body is approximately two to three times longer than the width thereof, providing greater stability and movement control. Further, the rear end of said body is also provided with an upturned portion 34, which is referred to as a "kick-up" means to prevent drag as the shoe oscillates about the axis of axles 28. Said upturned portion 34 also prevents drag or binding with the snow as the skateboard is made to turn in various directions. Also, there is included in ski shoe 14 upwardly and outwardly tapered side walls 36. The arrangement of said side walls 36 also makes allowance for a very smooth flow between the ski shoe and the snow—particularly during a turning sequence wherein the shoe will rotate slightly about the vertical axis of the truck assembly 12. The under surface of each ski shoe includes a pair of runner means which is integrally formed as part of the shoe and comprises a pair of runners 35 longitudinally disposed along the length of the shoe in parallel relation to each other, the runners having a somewhat triangular cross-section.

Each ski shoe is provided with a means by which it is removably secured to the truck assembly 12. As shown in FIGS. 2, 3, 5, and 6, this securing means comprises a pair of elongated strut members, generally indicated at 40, arranged in parallel relationship to each other and extending from the rear to the forward end. These struts also react as supporting, structural ribs to the main body 30. Hence, in this particular mode, struts 40 are spaced apart, each being formed adjacent side walls 36, as seen in FIG. 3. The struts include a recess 42—in this case, an enlarged semi-circular recess having a diameter substantially the same as that of wheel 26. However, the diameter is such that it can accommodate various sizes and diameters of wheels that are presently used with skateboards. This is accomplished by providing a keeper means which is herein shown as a strap 44 mounted at one end in well 45 formed in strut 40, said strap being secured in well 45 by pin 46. The free end of strap 44 includes a plurality of latching holes 47 which are positioned to receive tongue 48 of latch plate 50, the plate being secured to strut 40 by any suitable manner. Thus, various sized wheels can be readily accommodated for securing to said ski shoe 14.

In addition to the above securing means, the embodiment also includes restraining means which is formed as part of the ski shoe to prevent lateral movement of the shoe 14 relative to the skateboard. Said restraining means comprises a pair of vertically projecting, shoulder members 52, each being juxtaposed to the inner side of struts 40 and aligned with respective recesses 42, whereby the inner side of each wheel 26 engages the shoulders 52—thereby preventing sideward movement of said shoe 14.

Figure 8:
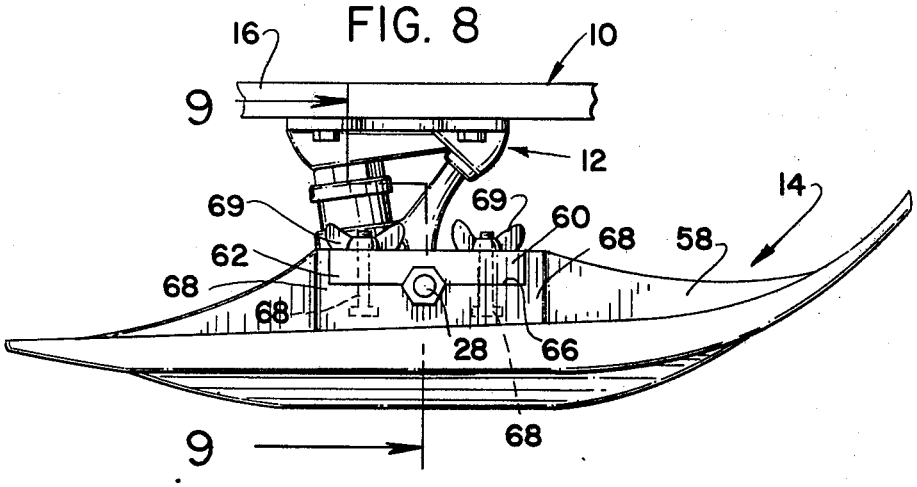
FIG. 8 is an enlarged view of one of the ski shoes as shown in FIG. 7 thereof.
Figure 9:
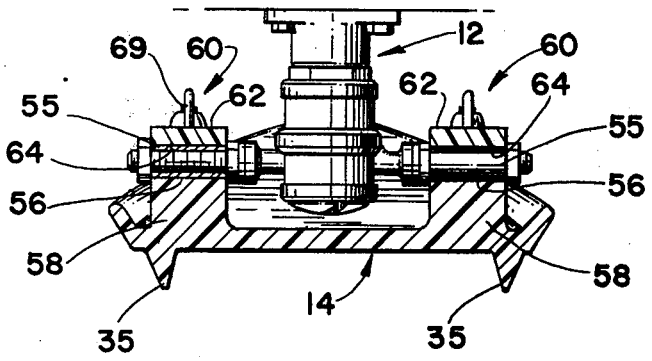
FIG. 9 is a cross-sectional view taken substantially along line 9—9 of FIG. 8.

Referring now to FIGS. 7 through 9, there is shown as alternative arrangement regarding the mounting means for mounting shoe 14 to truck 12. As previously stated, truck assembly 12 is attached to platform 16; however, in this arrangement, wheels 26 are first removed from the truck axles 28. The truck axles are provided with bearing sleeve members 55, whereby each axle and each bearing are received in respective recesses 56 formed in the oppositely disposed struts 58. In order to hold the axles in place, a clamping means, generally indicated at 60, is provided. Said clamping means comprises a clamping block 62 having a matching recess 64 centrally disposed therein so as to secure the axles 28 in struts 58, as seen in FIGS. 8 and 9. Block 62 can be mounted to the struts in any suitable manner; but it is preferred that block 62 be positioned within a groove 66. Thus, shoulders 68 are formed by groove 66, thus preventing outward stress thereon. Included therein is a pair of bolts 68 which, in this arrangement, are imbedded within struts 58 and are projected upwardly in order to pass through block 62 having wing nuts 69 threaded thereto, as is well known in the art. Further, in this arrangement restraining means for wheels 26 are not required.

Figure 10:
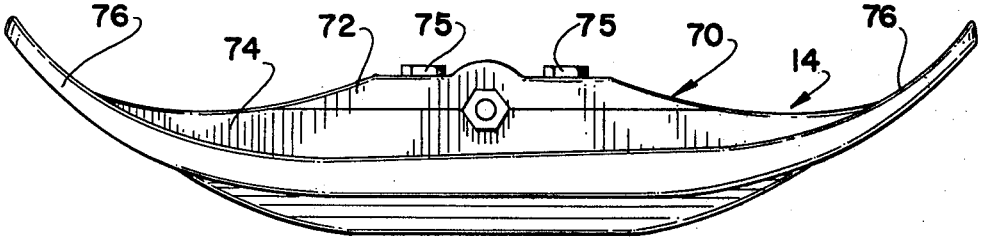
FIG. 10 is an alternative arrangement of the ski shoe having nose portions on both ends thereof.

Referring now to FIG. 10, there is illustrated a further embodiment having a clamping means 70 comprising a clamping block 72 secured to struts 74 by bolts 75, whereby bolts 75 are threadably received in struts 74. However, the important feature of this arrangement is the incorporating of an additional upturned nose member. That is, the ski shoe 14 includes nose members 76 at both ends of said shoe, thus allowing the skateboard ski to be used in any direction. This mode is conducive for use as a trick riding device.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and we do no wish to be restricted to the specific form shown or uses mentioned, except as defined in the accompanying claims.

We claim:

1. A skateboard ski adapted to be mounted to a skateboard having a wheel-and-truck assembly, wherein said skateboard ski comprises:

a ski shoe having a substantially flat, elongated mid-section;

an upturned nose portion formed at the forward end of said ski shoe;

means for removably securing said ski shoe to said wheel-and-truck assembly;

a strut-support means formed integrally with said ski shoe, whereon said removable securing means is mounted thereon, said strut-support means comprising a pair of elongated strut members positioned in parallel relation to each other, and each having an upwardly open recess longitudinally disposed therein, wherein said recess defines longitudinally spaced oppositely disposed sides in said strut member, whereby said wheel-and-truck assembly is removably received in said recess; and wherein said removably securing means comprises keeper means, said keeper means comprising an elongated strap member mounted to said strut member on one side of said recess, and a latch mounted to said strut member on the opposite side of said recess to receive said strap member, said recess being formed to receive the wheels of said truck assembly therein;

runners integrally formed on the under surface of said ski shoes;

kick-up means formed at the rearward end thereof, to prevent drag and binding with the snow;

restraining means formed adjacent an inner side of said recess on said ski shoe to prevent lateral movement of said ski shoe with respect to said wheel-and-truck assembly 2. A skateboard ski as recited in claim 1, wherein said ski shoe includes upwardly and outwardly formed, longitudinal wall members.

* * * * *